US010556430B2

(12) United States Patent
Matsuura et al.

(10) Patent No.: US 10,556,430 B2
(45) **Date of Patent: *Feb. 11, 2020**

(54) LIQUID JETTING HEAD

(71) Applicant: BROTHER KOGYO KABUSHIKI KAISHA, Nagoya-shi, Aichi-ken (JP)

(72) Inventors: Kazunari Matsuura, Komaki (JP); Keita Hirai, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/293,782

(22) Filed: Mar. 6, 2019

(65) Prior Publication Data

US 2019/0193398 A1 Jun. 27, 2019

Related U.S. Application Data

(63) Continuation of application No. 15/912,753, filed on Mar. 6, 2018, now Pat. No. 10,245,829.

(30) Foreign Application Priority Data

Mar. 15, 2017 (JP) ..... 2017-049875

(51) Int. Cl.

| | |
|---|---|
| ***B41J 2/14*** | (2006.01) |
| ***B41J 2/175*** | (2006.01) |
| ***B41J 2/15*** | (2006.01) |

(52) U.S. Cl.

CPC ..... *B41J 2/1404* (2013.01); *B41J 2/14072* (2013.01); *B41J 2/14233* (2013.01);
(Continued)

(58) Field of Classification Search

CPC .. B41J 2/1404; B41J 2/14072; B41J 2/14233; B41J 2/15; B41J 2/175; B41J 2/17596

See application file for complete search history.

(56) References Cited

U.S. PATENT DOCUMENTS

| | | | |
|---|---|---|---|
| 6,572,221 | B1 | 6/2003 | Harvey et al. |
| 8,926,071 | B2 | 1/2015 | Sekiya |

(Continued)

FOREIGN PATENT DOCUMENTS

| | | | |
|---|---|---|---|
| JP | 2001-519264 | A | 10/2001 |
| JP | 2010-522105 | A | 7/2010 |

(Continued)

*Primary Examiner* — Lamson D Nguyen

(74) *Attorney, Agent, or Firm* — Merchant & Gould P.C.

(57) ABSTRACT

A liquid jetting head includes: a channel substrate having a nozzle surface in which nozzles are open, the channel substrate being formed with pressure chambers communicating with the nozzles respectively; and an actuator covering the pressure chambers. The pressure chambers include first pressure chambers arranged in an arrangement direction to form a first pressure chamber row. The nozzles include first nozzles communicating with the pressure chambers respectively. Any two first nozzles that are adjacent in the arrangement direction are arranged at different positions in the channel substrate with respect to an orthogonal direction which is parallel to the nozzle surface and orthogonal to the arrangement direction and different in a first distance. The first distance is a distance in the orthogonal direction between each first nozzle and an end on one side in the orthogonal direction of the first pressure chamber communicating with the first nozzle.

18 Claims, 10 Drawing Sheets

(52) U.S. Cl.
CPC ..... *B41J 2/15* (2013.01); *B41J 2/175* (2013.01); *B41J 2/17596* (2013.01); *B41J 2/14201* (2013.01); *B41J 2002/14266* (2013.01); *B41J 2002/14459* (2013.01); *B41J 2202/12* (2013.01)

(56) References Cited

U.S. PATENT DOCUMENTS

| | | | | |
|---|---|---|---|---|
| 10,245,829 | B2 * | 4/2019 | Matsuura | B41J 2/14233 |
| 2008/0231669 | A1 | 9/2008 | Brost | |
| 2014/0285546 | A1 | 9/2014 | Furuta | |
| 2014/0292934 | A1 | 10/2014 | Ozaki et al. | |
| 2016/0243827 | A1 | 8/2016 | Hawkins et al. | |

FOREIGN PATENT DOCUMENTS

| | | | |
|---|---|---|---|
| JP | 2014-180801 | A | 9/2014 |
| JP | 2014-208451 | A | 11/2014 |

* cited by examiner

LIQUID JETTING HEAD

CROSS REFERENCE TO RELATED APPLICATION

The present application is a continuation of U.S. patent application Ser. No. 15/912,753, filed Mar. 6, 2018, which further claims priority from Japanese Patent Application No. 2017-049875, filed on Mar. 15, 2017, the disclosures of both of which are incorporated herein by reference in their entirety.

BACKGROUND

Field of the Invention

The present invention relates to a liquid jetting head having a channel substrate in which at least one pressure-chamber row is formed.

Description of the Related Art

A liquid jetting head having a channel substrate in which pressure chambers are formed has been known. In the channel substrate the pressure chambers form at least one pressure chamber row. Nozzles belonging to one pressure-chamber row are arranged in a nozzle plate to be shifted in an orthogonal direction, which is parallel to a nozzle surface and orthogonal to an arrangement direction of the pressure chambers. In other words, a position in the orthogonal direction of each nozzle differs from a position in the orthogonal direction of another nozzle which is adjacent in the arrangement direction.

SUMMARY

However, when viewed from a direction orthogonal to the nozzle surface, these nozzles are positioned at substantial center in the orthogonal direction of the pressure chamber which communicates with that nozzle (in other words, a shift of the nozzle in the orthogonal direction is comparatively small). Therefore, an air curtain along the arrangement direction is susceptible to be formed by an air flow generated by jetting of liquid from each nozzle. In this case, an air flow in the orthogonal direction generated due to conveying of a paper runs against into the air curtain, and the air flow is perturbed. Therefore, a problem that the liquid jetted from each nozzle does not land at a desired position may arise.

An object of the present teaching is to provide a liquid jetting head in which the perturbation of air flow is hard to occur, and a problem that the liquid jetted from each nozzle does not land at a desired position is suppressed from arising.

According to an aspect of the present teaching, there is provided a liquid jetting head including: a channel substrate having a nozzle surface in which nozzles are open, the channel substrate being formed with pressure chambers communicating with the nozzles respectively; and an actuator covering the pressure chambers, wherein the pressure chambers include first pressure chambers arranged in an arrangement direction to form a first pressure chamber row in the channel substrate, each of the first pressure chambers has a first end on one side in an orthogonal direction and a second end on the other side in the orthogonal direction, the orthogonal direction being parallel to the nozzle surface and orthogonal to the arrangement direction, the nozzles include first nozzles communicating with the first pressure chambers respectively, any two first nozzles, which are included in the first nozzles and adjacent to each other in the arrangement direction, are arranged at different positions in the channel substrate with respect to the orthogonal direction and different in a first distance, the first distance being a distance in the orthogonal direction between each first nozzle and the first end of each first pressure chamber communicating with the first nozzle, the first nozzles include farthest two first nozzles that are separated from each other farthest with respect to the orthogonal direction, and a second distance in the orthogonal direction between the farthest two first nozzles is not less than a third distance, the third distance being a distance between each of the farthest two first nozzles and a nearest end of each first pressure chamber communicating with the first nozzle, the nearest end of the first pressure chamber being one of the first end and the second end which is nearer to the first nozzle in the orthogonal direction.

DESCRIPTION OF THE EMBODIMENTS

First Embodiment

Figure 1:
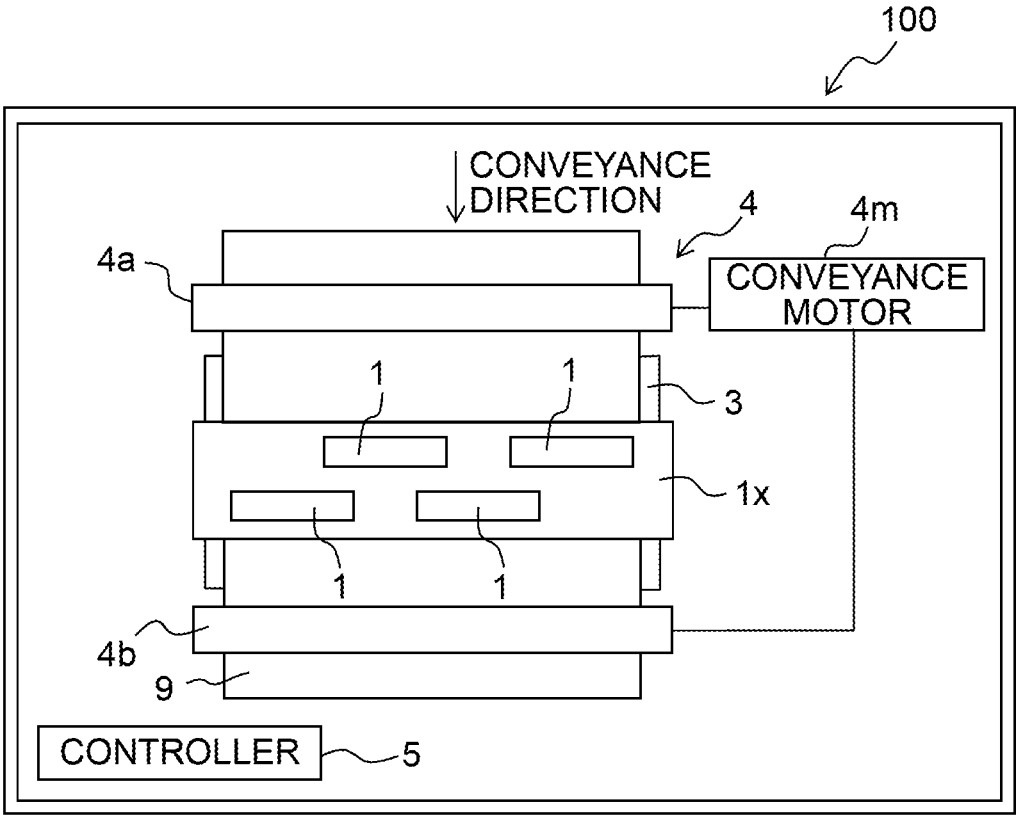
FIG. 1 is a schematic plan view of a printer provided with a head according to a first embodiment of the present teaching.

Firstly, an overall arrangement of a printer 100 will be described below by referring to FIG. 1. The printer 100 includes a head unit 1*x*, a platen 3, a conveyance mechanism 4, and a controller 5.

The head unit 1*x* is of a line type (in other words, a type in which an ink is jetted onto a paper 9 in a state that a position of the head unit 1*x* is fixed), and is long in a direction orthogonal to a conveyance direction of the paper 9. The head unit 1*x* includes four heads 1 according to a first embodiment of the present teaching. The four heads 1 are arranged in a zigzag form along the direction orthogonal to the conveyance direction. The four heads 1 have the same structure. Each head 1 jets ink from a plurality of nozzles 11*n* (refer to FIG. 2 and FIG. 3).

The platen 3 is arranged at a lower side of the head unit 1*x*. The ink is jetted from each head 1 onto a paper 9 supported by the platen 3.

The conveyance mechanism 4 includes two pairs of rollers 4*a* and 4*b* arranged to sandwich the platen 3 in the conveyance direction. As a conveyance motor 4*m* is driven, the two rollers in each of the pair of rollers 4*a* and 4*b* are rotated in mutually opposite directions in a state of pinching the paper 9. Accordingly, the paper 9 is conveyed in the conveyance direction.

The controller 5 controls the four heads 1, the conveyance motor 4*m*, and the like, such that an image is recorded on the paper 9 on the basis of a recording command that has been inputted from an external apparatus such as a PC (personal computer).

Next, an arrangement of the head 1 will be described below by referring to FIG. 2 to FIG. 4. The head 1 includes a channel substrate 11, an actuator 12, and a tank 14.

Figure 3:
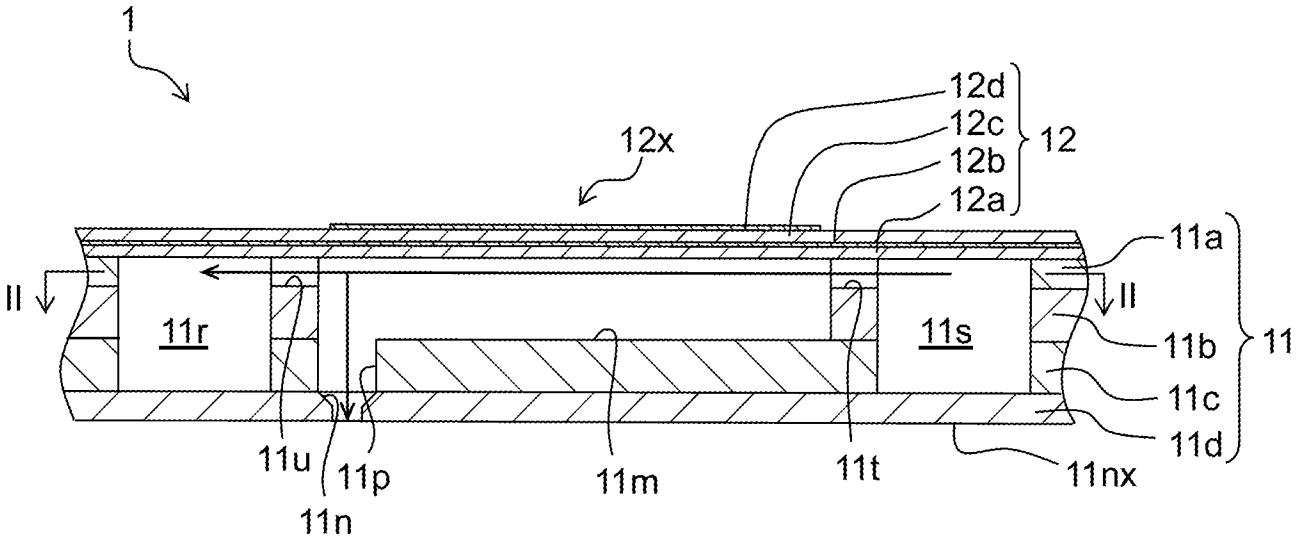
FIG. 3 is a cross-sectional view along a line III-III in FIG. 2.
Figure 4:
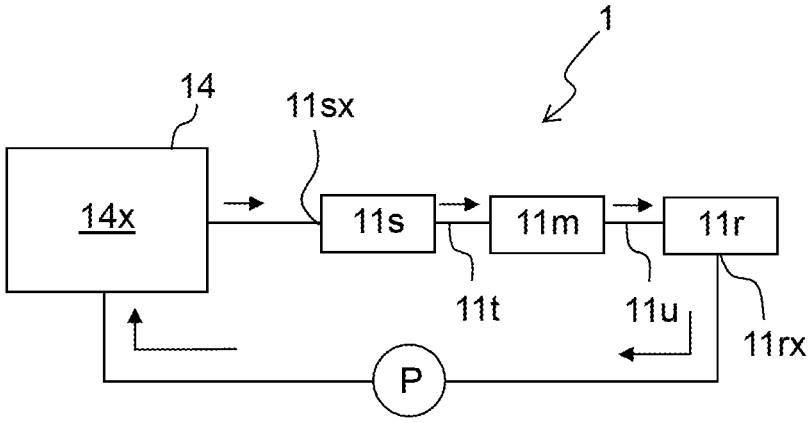
FIG. 4 is a schematic diagram depicting a flow of ink from a tank in the head.

The channel substrate 11, as depicted in FIG. 3, includes four plates 11*a*, 11*b*, 11*c*, and 11*d* (hereinafter plates 11*a* to 11*d*), and the four plates 11*a* to 11*d* are adhered to one another. An upper portion of a pressure chamber 11*m*, an upper portion of a supply channel 11*s*, an upper portion of a return channel 11*r*, and throttles 11*t* and 11*u* are formed to penetrate the plate 11*a*. A lower portion of the pressure chamber 11*m*, a central portion in a vertical direction of the supply channel 11*s*, and a central portion in the vertical direction of the return channel 11*r* are formed to penetrate the plate 11*b*. A lower portion of the supply channel 11*s*, a lower portion of the return channel 11*r*, and a descender 11*p* which connects the pressure chamber 11*m* and the nozzle 11*n* are formed to penetrate the plate 11*c*. The nozzle 11*n* is formed to penetrate the plate 11*d*.

Figure 2:
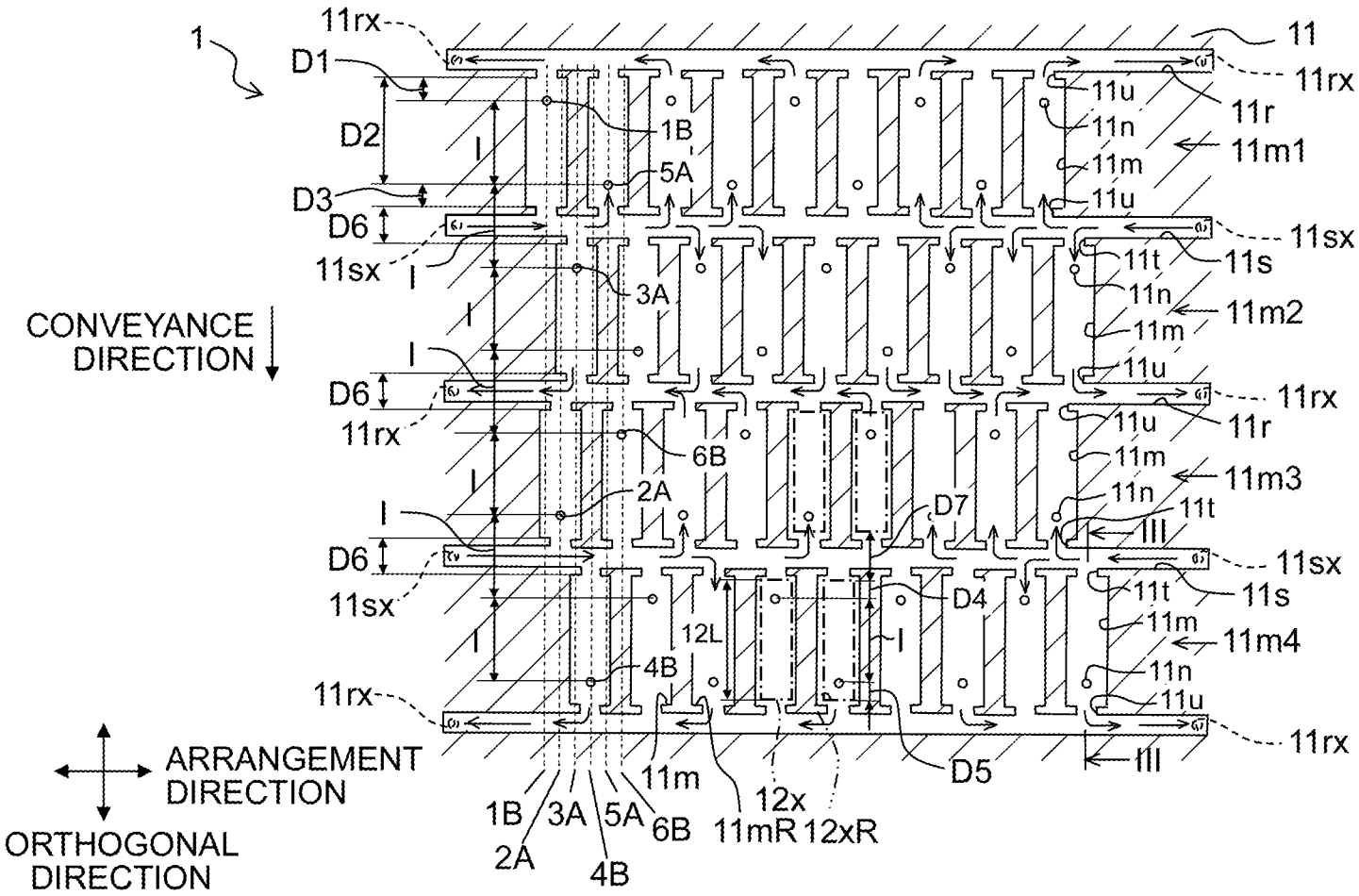
FIG. 2 is a cross-sectional view (a cross-sectional view along a line II-II in FIG. 3) depicting a portion of a channel formed in a channel substrate of the head.

A lower surface of the channel substrate 11 (lower surface of the plate 11*d*) is a nozzle surface 11*nx* in which the plurality of nozzles 11*n* are open as depicted in FIG. 2 and FIG. 3. The nozzles 11*n* have the same shape and size.

Pressure chambers 11*m* are open in an upper surface of the channel substrate 11 (upper surface of the plate 11*a*) as depicted in FIG. 2 and FIG. 3. The pressure chambers 11*m* communicate with the nozzles 11*n* respectively. The plurality of pressure chambers 11*m* have the same shape and size.

The pressure chambers 11*m* are arranged to form four pressure-chamber rows 11*m*1, 11*m*2, 11*m*3, and 11*m*4 (hereinafter, pressure-chamber rows 11*m*1 to 11*m*4) as depicted in FIG. 2. The pressure chambers 11*m* in each of the pressure-chamber rows 11*m*1 to 11*m*4 are arranged at an equal distance in an arrangement direction (direction orthogonal to the conveyance direction). The four pressure-chamber rows 11*m*1 to 11*m*4 are arranged side-by-side in an orthogonal direction (direction orthogonal to the arrangement direction, and a direction parallel to the conveyance direction). The pressure chambers 11*m* forming each of the pressure-chamber rows 11*m*1 to 11*m*4 are formed at the same position in the orthogonal direction. The pressure chambers 11*m* are arranged in a zigzag form such that respective positions thereof in the arrangement direction differ.

Each of the supply channel 11*s* and the return channel 11*r* is extended in the arrangement direction as depicted in FIG. 2.

The supply channel 11*s* is provided one each between the pressure-chamber row 11*m*1 and the pressure-chamber row 11*m*2, and between the pressure-chamber row 11*m*3 and the pressure-chamber row 11*m*4. The return channel 11*r* is provided one each at an upstream side in the conveyance direction of the pressure-chamber row 11*m*1, between the pressure-chamber row 11*m*2 and the pressure-chamber row 11*m*3, and at a downstream side in the conveyance direction of the pressure-chamber row 11*m*4.

A supply port 11*sx* is formed at two ends of the arrangement direction of each supply channel 11*s*. A return port 11*rx* is formed at each of two ends in the arrangement direction of each return channel 11*r*. The supply ports 11*sx* and the return ports 11*rx* are open in a surface of the channel substrate 11. As depicted in FIG. 4, the supply channel his and the return channel 11*r* communicate with a storage chamber 14*x* of the tank 14 via a tube connected to the supply port 11*sx* and the return port 11*rx* respectively. Ink is stored in the storage chamber 14*x*. The ink in the storage chamber 14*x* inflows into the supply channel 11*s* via the supply port 11*sx* by a drive of a pump P, and is supplied to each pressure chamber 11*m* through a throttle 11*t*. Some of the ink supplied to each pressure chamber 11*m* is jetted from one of the nozzles 11*n*, and the remaining ink inflows into the return channel 11*r* through the throttle 11*u*, and is returned to the storage chamber 14*x* via the return port 11*rx*.

The supply channel 11*s* and the return channel 11*r* are arranged at the same height. The throttle 11*t* and the throttle 11*u* are arranged at the same height.

The supply channel 11*s* provided between the pressure-chamber row 11*m*1 and the pressure-chamber row 11*m*2 supplies ink to each pressure chamber 11*m* in these two pressure-chamber rows 11*m*1 and 11*m*2. The supply channel 11*s* provided between the pressure-chamber row 11*m*3 and the pressure-chamber row 11*m*4 supplies ink to each pressure chamber 11*m* in these two pressure chamber rows 11*m*3 and 11*m*4.

The return channel 11*r* provided to the upstream side of the conveyance direction of the pressure-chamber row 11*m*1 returns the ink to the storage chamber 14*x* from each pressure chamber 11*m* in the pressure-chamber rows 11*m*1. The return channel 11*r* provided between the pressure-chamber row 11*m*2 and the pressure-chamber row 11*m*3 returns the ink to the storage chamber 14*x* from each pressure chamber 11*m* in these two pressure-chamber rows 11*m*2 and 11*m*3. The return channel 11*r* provided to the downstream side in the conveyance direction of the pressure-chamber row 11*m*4 returns the ink to the storage chamber 14*x* from each pressure chamber 11*m* in the pressure-chamber row 11*m*4.

The actuator 12, as depicted in FIG. 3, is arranged on an upper surface of the channel substrate 11 to cover the plurality of pressure chambers 11*m*. The actuator 12 includes in order from a lower side, a vibration plate 12*a*, a common electrode 12*b*, a piezoelectric layer 12*c*, and a plurality of individual electrodes 12*d*. While the vibration plate 12*a*, the common electrode 12*b*, and the piezoelectric layer 12*c* are arranged to cover the plurality of pressure chambers 11*m* (in other words, to be spread over the plurality of pressure chambers 11*m*), the individual electrodes 12*d* are arranged to face the pressure chambers 11*m* respectively. The common electrode 12*b* is grounded.

A portion of the piezoelectric layer 12*c* sandwiched between the individual electrode 12*d* and the common electrode 12*b* functions as an active portion 12*x* which is deformable according to a voltage applied to the individual electrode 12*d*. In other words, the actuator 12 includes active portions 12*x* facing the pressure chambers 11*m* respectively, in a direction orthogonal to the nozzle surface 11*nx* (refer to FIG. 2). By driving the active portion 12*x* (in other words, by deforming (such that the active portion 12*x* forms a projection toward the pressure chamber 11*m*) the active portion 12$x$ according to the voltage applied to the individual electrode 12$d$), volume of the pressure chamber 11$m$ changes. At this time, pressure is applied to the ink in the pressure chamber 11$m$, and the ink is jetted from the nozzle 11$n$.

Next, an arrangement of the nozzles 11$n$ will be described in detail by referring to FIG. 2.

Each nozzle 11$n$ is arranged in an area of the pressure chamber 11$m$ (a pressure chamber area 11$m$R) communicating with the nozzle 11$n$, and in an area of the active portion 12$x$ (an active portion area 12$x$R) facing the pressure chamber 11$m$ which communicates with the nozzle 11$n$. The pressure chamber area 11$m$R is an area formed by projecting the pressure chamber 11$m$ on the nozzle surface 11$nx$, from the direction orthogonal to the nozzle surface 11$nx$. The active portion area 12$x$R is an area formed by projecting the active portion 12$x$R on the nozzle surface 11$nx$, from the direction orthogonal to the nozzle surface 11$nx$.

Among the nozzles 11$n$ belonging to each of the pressure chamber rows 11$m$1 to 11$m$4 (in other words, communicating with the pressure chambers 11$m$ forming each of the pressure chamber rows 11$m$1 to 11$m$4), any two nozzles 11$m$ adjacent in the arrangement direction are different in a distance in an orthogonal direction from one end in the orthogonal direction of the pressure chamber 11$m$ communicating with the nozzle 11$n$, and are arranged at different positions with respect to the orthogonal direction. As depicted in FIG. 2, with respect to the first nozzle 11$n$ and the second nozzle 11$n$ from left in the pressure chamber row 11$m$1, a distance D1 in the orthogonal direction from one end (upper end in FIG. 2) of the pressure chamber 11$m$ communicating with the first nozzle 11$n$ differs from a distance D2 in the orthogonal direction from one end of the pressure chamber 11$m$ communicating with the second nozzle 11$n$. Moreover, a position in the orthogonal direction of the first nozzle 11$n$ differs from a position in the orthogonal direction of the second nozzle 11$n$.

Among the nozzles 11$n$ belonging to each of the pressure chamber rows 11$m$1 to 11$m$4, a position in the orthogonal direction of each nozzle 11$n$, excluding nozzles 11$n$ positioned at both ends in the arrangement direction, is different from a position in the orthogonal direction of each of nozzles 11$n$ adjacent on both sides in the arrangement direction of the nozzle 11$n$. In the present embodiment, a position in the orthogonal direction of the nozzles 11$n$ belonging to each of the pressure chamber rows 11$m$1 to 11$m$4 differs for each in the arrangement direction, and is the same for alternate nozzles in the arrangement direction. In other words, the nozzles 11$n$ belonging to each of the pressure chamber rows 11$m$1 to 11$m$4 form two nozzle rows arranged in the orthogonal direction. Each nozzle row includes a plurality of nozzles 11$n$ arranged in the arrangement direction.

The four pressure chamber rows 11$m$1 to 11$m$4 have the same distance I between two nozzles. The distance I between two nozzles is a distance in the orthogonal direction between two most separated (two mutually farthest) nozzles 11$n$ in the orthogonal direction (in the present embodiment, two mutually adjacent nozzles 11$n$ in the arrangement direction).

The distance I between the two nozzles is not less than the shortest distance between these two nozzles 11$n$. The shortest distance is a distance in the orthogonal direction between each of these two nozzles 11$n$ and the nearest end of the one pressure chamber 11$m$ communicating with the nozzle 11$n$. The nearest end is an end portion nearer to the nozzle 11$n$ out of the two end portions in the orthogonal direction of the pressure chamber 11$m$. For example, in FIG. 2, a shortest distance D1 of the first nozzle 11$n$ from left of the pressure chamber row 11$m$1 is a distance between the nozzle 11$n$ and the nearest end (an upper end in FIG. 2) of the one pressure chamber 11$m$ communicating with the nozzle 11$n$. Similarly, a shortest distance D3 of the second nozzle 11$n$ from left of the pressure chamber row 11$m$1 is a distance between the nozzle 11$n$ and the nearest end (a lower end in FIG. 2) of the pressure chamber 11$m$ communicating with that nozzle 11$n$. The distance I between the first nozzle 11$n$ from left in the pressure chamber row 11$m$1 and the second nozzle 11$n$ from left in the pressure chamber row 11$m$1 is not less than the shortest distance D1 of the first nozzle 11$n$ from left, and is also not less than the shortest distance D3 of the second nozzle 11$n$ from left.

In the present embodiment, the shortest distance D1 and the shortest distance D3 are equal. Moreover, for all the pressure chamber rows 11$m$1 to 11$m$4, the two most separated nozzles 11$n$ in the orthogonal direction have the same distance in the orthogonal direction from the nozzle 11$n$ up to an end portion, of the pressure chamber 11$m$ communicating with the nozzle 11$n$, which is nearer to the nozzle 11$n$ in the orthogonal direction out of the two ends in the orthogonal direction. In other words, for all the pressure chambers 11$m$ of the head 1, a relative positional relationship of the pressure chamber 11$m$ and the nozzle 11$n$ is the same. Accordingly, it is possible to suppress a problem of unevenness in jetting characteristics (such as a size of ink droplets jetted from the nozzle 11$n$, a jetting speed (velocity), and a jetting direction).

Moreover, the distance I is a distance in the orthogonal direction from the nozzle 11$n$ up to an end portion nearer to the nozzle 11$n$ in the orthogonal direction out of two ends in the orthogonal direction of the active portion 12$x$ facing the pressure chamber 11$m$ communicating with the nozzle 11$n$, in each of the two nozzles 11$n$. Specifically, in FIG. 2, when a fourth and a fifth nozzles 11$n$ from left of the pressure chamber row 11$m$4 are targeted, the distance I is not less than a distance D4 in the orthogonal direction, from the fourth nozzle 11$n$ from left in the pressure chamber row 11$m$4 up to the end portion (an upper end in FIG. 2) nearer to the nozzle 11$n$ in the orthogonal direction out of the two ends in the orthogonal direction of the active portion 12$x$ facing the pressure chamber 11$m$ communicating with the nozzle 11$n$, and is not less than a distance D5 in the orthogonal direction, from the fifth nozzle 11$n$ from left in the pressure chamber row 11$m$4 up to an end portion (a lower end in FIG. 2) nearer to the nozzle 11$n$ in the orthogonal direction out of the two ends in the orthogonal direction of the active portion 12$x$ facing the pressure chamber 11$m$ communicating with the nozzle 11$n$.

Furthermore, the distance I is not less than a distance D6 in the orthogonal direction between the pressure chambers 11$m$ in the pressure chamber row to which these two nozzles 11$n$ belong and the pressure chambers 11$m$ in another pressure chamber row which is adjacent to the pressure chamber row in the orthogonal direction. The four pressure chamber rows 11$m$1 to 11$m$4 are arranged at the equal distance D6 in the orthogonal direction. In other words, the distance D6 in the orthogonal direction between the pressure chambers 11$m$ forming the pressure chamber row 11$m$1 and the pressure chambers 11$m$ forming the pressure chamber row 11$m$2, the distance D6 in the orthogonal direction between the pressure chambers 11$m$ in the pressure chamber row 11$m$2 and the pressure chambers 11$m$ forming the pressure chamber row 11$m$3, the distance D6 in the orthogonal direction between the pressure chambers 11$m$ forming the pressure chamber row 11$m$3 and the pressure chambers 11$m$ forming the pressure chamber row 11$m$4 are the same.

The distance D6 is smaller than a length 12L in the orthogonal direction of each active portion 12$x$.

The distance I is not less than a distance D7 between the active portions 12$x$ belonging to the pressure chamber row to which these two nozzles 11$n$ belong and the active portions 12$x$ belonging to another pressure chamber row which is adjacent in the orthogonal direction to the pressure chamber row. The active portions 12$x$, similar to the pressure chambers 11$m$, are also arranged at the same distance D7 in the orthogonal direction.

The distance I is equal to the minimum distance in the orthogonal direction from the nozzles 11$n$ belonging to the one pressure chamber row up to the nozzles 11$n$ belonging to another pressure chamber row which is adjacent in the orthogonal direction to the pressure chamber row. In other words, the nozzles 11$n$ belonging to all the pressure chamber rows 11$m$1 to 11$m$4 is arranged at the equal distance (distance I) in the orthogonal direction.

Moreover, the distance I is an even multiple of a distance corresponding to the maximum resolution in the orthogonal direction. Specifically, in the present embodiment, the maximum resolution in the orthogonal direction is 1200 dpi (dots per inch), and the distance corresponding to the maximum resolution in the orthogonal direction is 42 μm. Therefore, the distance I is an even multiple of 42 μm (such as 42 μm×2=84 μm and 42 μm×4=168 μm).

Furthermore, when there is a plurality of patterns of a distance in the orthogonal direction from the supply channel 11$s$ that supplies an ink to the pressure chamber 11$m$ communicating with the nozzle 11$n$, of the plurality of nozzles 11$n$ corresponding to the plurality of dots lined up in the arrangement direction, the plurality of nozzles 11$n$ is arranged in a pattern in which the frequency of consecutive nozzles 11$n$ with the equal distance in the orthogonal direction from the supply channel 11$s$, is the minimum. Specifically, in FIG. 2, numbers "1" to "6" are assigned in order from left, to the plurality of nozzles 11$n$ corresponding to a plurality of dots lined up in the arrangement direction, and a nozzle 11$n$ for which the distance in the orthogonal direction from the supply channel 11$s$ is comparatively small is let to be "A" and a nozzle 11$n$ for which the distance in the orthogonal direction from the supply channel is longer than for "A" is let to be "B" (in the present embodiment, since the nozzles 11$n$ belonging to each pressure chamber row form two nozzle rows, the nozzles are classified into two which are "A" and "B". In the present embodiment, the nozzles 11$n$ from "1" to "6" are "B", "A", "A", "B", "A", and "B".

Figure 5:
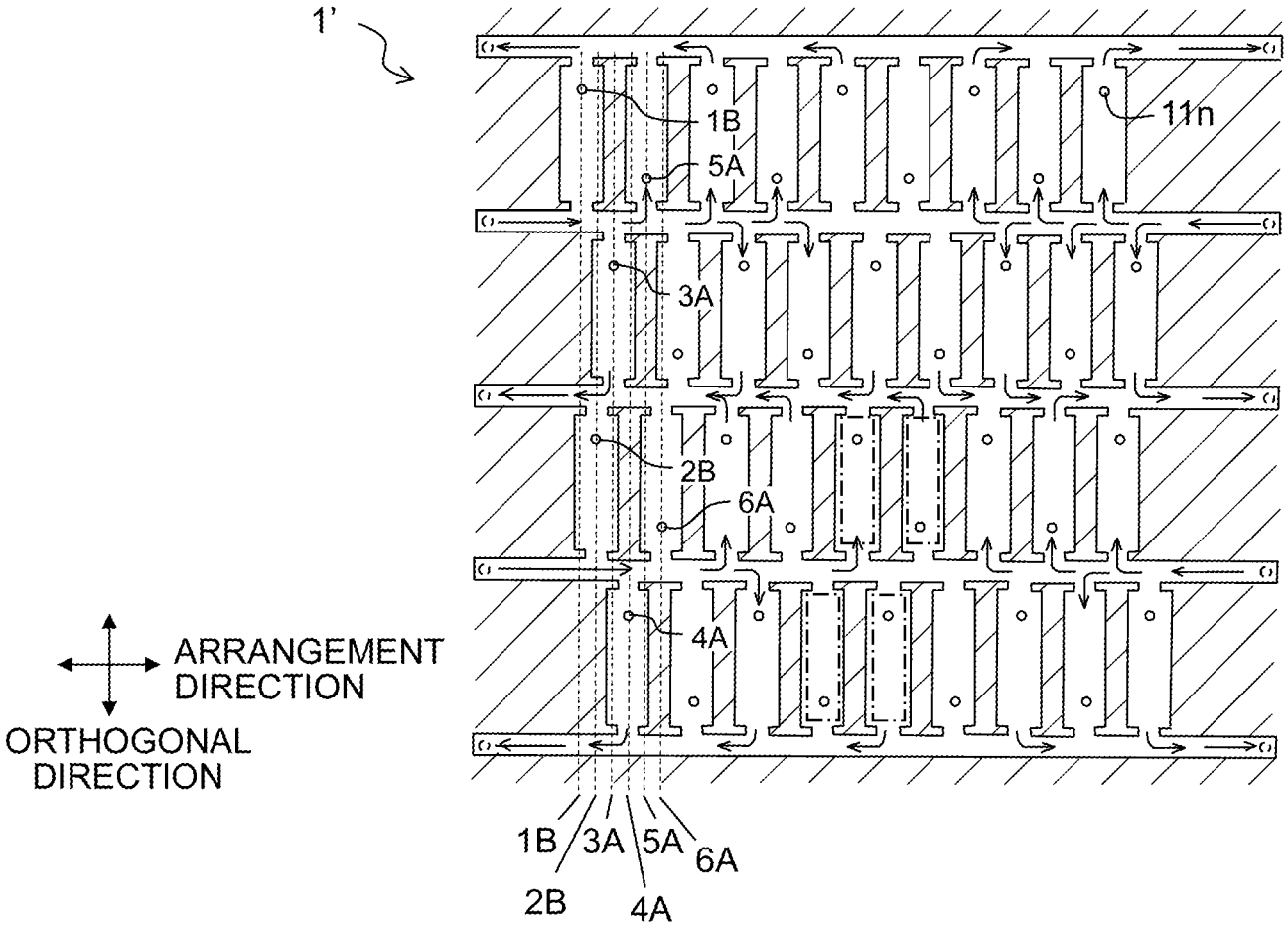
FIG. 5 is a cross-sectional view, of a head according to a modified embodiment of the first embodiment of the present teaching, corresponding to FIG. 2.

On the other hand, in a head 1' according to a modified embodiment in FIG. 5, numbers "1" to "6" are assigned in order from left to the plurality of nozzles 11$n$ corresponding to the plurality of dots lined up in the arrangement direction, and when the nozzles 11$n$ are classified similarly as mentioned above, the nozzles 11$n$ from "1" to "6" are "B", "B", "A", "A", "A", and "A". In other words, in the modified embodiment in FIG. 5, the number of consecutive nozzles 11$n$ with the equal distance in the orthogonal direction from the supply channel 11$s$ is large as "A", "A", "B", "B" compared to the frequency of consecutive nozzles 11$n$ in the present embodiment.

In a case in which the nozzles 11$n$ belonging to each pressure chamber row form two nozzle rows, there are various patterns of arrangement of the nozzles 11$n$ including the pattern in the modified embodiment in FIG. 5. In the present embodiment, of the various patterns, a pattern in which the frequency of the consecutive nozzles 11$n$ with the equal distance in the orthogonal direction from the supply channel 11$s$ is the minimum, which is also a pattern in which the nozzles 11$n$ with the equal distance in the orthogonal direction from the supply channel 11$s$ are not consecutive for not less than 84 μm has been adopted.

As described above, according to the present embodiment, the plurality of nozzles 11$n$ belonging to the pressure chamber rows 11$m$1 to 11$m$4 are arranged such that the distance in the orthogonal direction from one end in the orthogonal direction of the pressure chamber 11$m$ communicating with the nozzle 11$n$ differs mutually from the distance for another nozzle which is adjacent in the arrangement direction (for example, D1≠D2 in FIG. 2), and the position in the orthogonal direction differs mutually from the position of another nozzle 11$n$. Moreover, the distance I in the orthogonal direction between the two nozzles 11$n$ most separated mutually in the orthogonal direction, out of the plurality of nozzles 11$n$ belonging to the pressure chamber rows 11$m$1 to 11$m$4 is not less than the distance (for example D1 and D3 in FIG. 2) from the nozzle 11$n$ up to the end portion near the nozzle 11$n$ in the orthogonal direction out of the two ends in the orthogonal direction of the one pressure chamber 11$m$ communicating with the nozzles 11$n$, for each of the two nozzles 11$n$. In other words, the plurality of nozzles 11$n$ belonging to the pressure chamber rows 11$m$1 to 11$m$4 is arranged to be shifted in the orthogonal direction, and the shift of the nozzles 11$n$ in the orthogonal direction is comparatively large. Therefore, an air curtain along the arrangement direction is hard to be formed, and an air flow in the orthogonal direction, which is generated due to the conveyance of the paper 9, can pass easily between the nozzles 11$n$ adjacent in the arrangement direction. Accordingly, the air flow is hardly perturbed, and it is possible to suppress a problem of the ink jetted from each nozzle 11$n$ not landing at a desired position.

Positions in the orthogonal direction of the plurality of pressure chambers 11$m$ forming the pressure chamber rows 11$m$1 to 11$m$4 are same. When the plurality of pressure chambers 11$m$ forming the pressure chamber rows 11$m$1 to 11$m$4 is lined up to be shifted, a size of the channel substrate 11 in the orthogonal direction becomes large. Whereas, since the positions in the orthogonal direction of the plurality of pressure chambers 11$m$ forming the pressure chamber rows 11$m$1 to 11$m$4 are aligned, it is possible to make the perturbation of the air flow hard to occur by the arrangement of the nozzles 11$n$, while avoiding the size of the channel substrate 11 in the orthogonal direction becoming large.

The nozzles 11$n$ are arranged in the pressure chamber area 11$m$R. Accordingly, it is possible to carry out the jetting of ink efficiently from each nozzle 11$n$.

The distance I is not less than the distance (for example, the distance D4 and D5 in FIG. 2) in the orthogonal direction from the nozzle 11$n$ up to the end portion near the nozzle 11$n$ in the orthogonal direction out of the two ends in the orthogonal direction of the active portion 12$x$ facing the pressure chamber 11$m$ communicating with the nozzle 11$n$. Accordingly, it is possible to make large assuredly, the shift in the orthogonal direction of the plurality of nozzles 11$n$ belonging to the pressure chamber rows 11$m$1 to 11$m$4.

The nozzles 11$n$ are arranged in the active portion area 12$x$R. Accordingly, it is possible to carry out the jetting of ink efficiently from each nozzle 11$n$.

The position in the orthogonal direction of the nozzle other than the nozzles positioned at ends in the arrangement direction, out of the plurality of nozzles 11$n$ belonging to each of the pressure chamber rows 11$m$1 to 11$m$4, differs from the positions of the nozzles adjacent on both sides in the arrangement direction. Therefore, the air curtain along the arrangement direction is even harder to be formed, and the air flow in the orthogonal direction which is generated due to the conveyance of the paper 9 can pass easily between the nozzles 11*n* adjacent in the arrangement direction. Accordingly, the air flow is hardly perturbed, and it is possible to suppress more assuredly, the problem of the ink jetted from each nozzle 11*n* not landing at a desired position.

The distance I is equal to the minimum distance in the orthogonal direction from the plurality of nozzles 11*n* belonging to the one pressure chamber row up to the plurality of nozzles 11*n* belonging to another pressure chamber row which is adjacent to the pressure chamber row in the orthogonal direction. By letting the distance I to be not less than the minimum distance, it is possible to make large assuredly, the shift in the orthogonal direction of the plurality of nozzles 11*n* belonging to the pressure chamber rows 11*m*1 to 11*m*4. Furthermore, in the present embodiment, the distance I being equal to the minimum distance, the nozzles 11*n* are arranged at an equal distance in the orthogonal direction, in the two pressure chamber rows that are mutually adjacent in the orthogonal direction. Therefore, the air curtain along the arrangement direction is even harder to be formed, and the air flow in the orthogonal direction which is generated due to the conveyance of the paper P can pass easily between the nozzles 11*n* adjacent in the arrangement direction. Accordingly, the air flow is hardly perturbed, and it is possible to suppress more assuredly, the problem of the ink jetted from each nozzle 11*n* not landing at a desired position.

The nozzles 11*n* belonging to all the four pressure chamber rows 11*m*1 to 11*m*4 are arranged at an equal distance (distance I) in the orthogonal direction. Accordingly, the perturbation of the air flow is hardly caused, and it is possible to suppress more assuredly, the problem of the ink jetted from each nozzle 11*n* not landing at a desired positon.

The distance I is not less than the distance D6 in the orthogonal direction between the pressure chambers 11*m* forming the pressure chamber row to which these two nozzles 11*n* belong and the pressure chambers 11*m* forming another pressure chamber row adjacent in the orthogonal direction to the pressure chamber row. Accordingly, it is possible to make large even more assuredly, the shift in the orthogonal direction of the nozzles 11*n* belonging to each of the pressure chamber rows 11*m*1 to 11*m*4.

The distance I is not less than the distance D7 in the orthogonal direction between the plurality of active portions 12*x* belonging to the pressure chamber row to which these two nozzles 11*n* belong and the plurality of active portions 12*x* belonging to another pressure chamber row which is adjacent in the orthogonal direction to the pressure chamber row. Accordingly, it is possible to make large even more assuredly, the shift in the orthogonal direction of the plurality of nozzles 11*n* belonging to each of pressure chamber rows 11*m*1 to 11*m*4.

The distance D6 is smaller than the length 12L in the orthogonal direction of the one active portion 12*x*. Therefore, it is possible to arrange the pressure chamber rows 11*m*1 to 11*m*4 at a small distance, and the pressure chambers 11*m* highly densely.

The supply channel 11*s* and the return channel 11*r* are formed in the channel substrate 11. Therefore, it is possible to circulate the ink between the storage chamber 14*x* and each pressure chamber 11*m*. Accordingly, it is possible to eliminate an air bubble in the ink. Moreover, an increase in viscosity of the ink is prevented.

When there is a plurality of patterns of the distance in the orthogonal direction from the supply channel 11*s* that supplies an ink to the pressure chamber 11*m* communicating with the nozzle 11*n*, of the plurality of nozzles corresponding to the plurality of dots arranged in the arrangement direction, the plurality of nozzles 11*n* is arranged in the pattern in which the frequency of consecutive nozzles 11*n* with the equal distance in the orthogonal direction from the supply channel 11*s*, is the minimum (For example, the nozzles 11*n* from "1" to "6" are arranged in a pattern of "B", "A", "A", "B", "A", and "B"). The jetting characteristics may change according to the distance in the orthogonal direction from the supply channel 11*s*. Therefore, when the frequency of consecutive nozzles 11*n* with the equal distance in the orthogonal direction from the supply channel 11*s* is large, a difference in characteristics becomes remarkable, and an image quality is deteriorated due to occurrence of lines (stripes) in an image. Regarding this point, it is possible to reduce the problem by the arrangement described above.

The plurality of nozzles 11*n* corresponding to the plurality of dots lined up in the arrangement direction is arranged in the pattern in which the nozzles 11*n* with the equal distance in the orthogonal direction from the supply channel 11*s* are not consecutive for 84 μm or more. When the nozzles 11*n* with the equal distance in the orthogonal direction from the supply channel 11*s* are consecutive for not less than 84 μm, the difference in characteristics is easily visible to a person. With regard to this point, it is possible to reduce the problem by the arrangement described above.

The distance I is an even multiple of the distance corresponding to the maximum resolution in the orthogonal direction. Accordingly, it is easy to deal with a degradation of resolution in the orthogonal direction due to a change in a printing mode.

Second Embodiment

Figure 6:
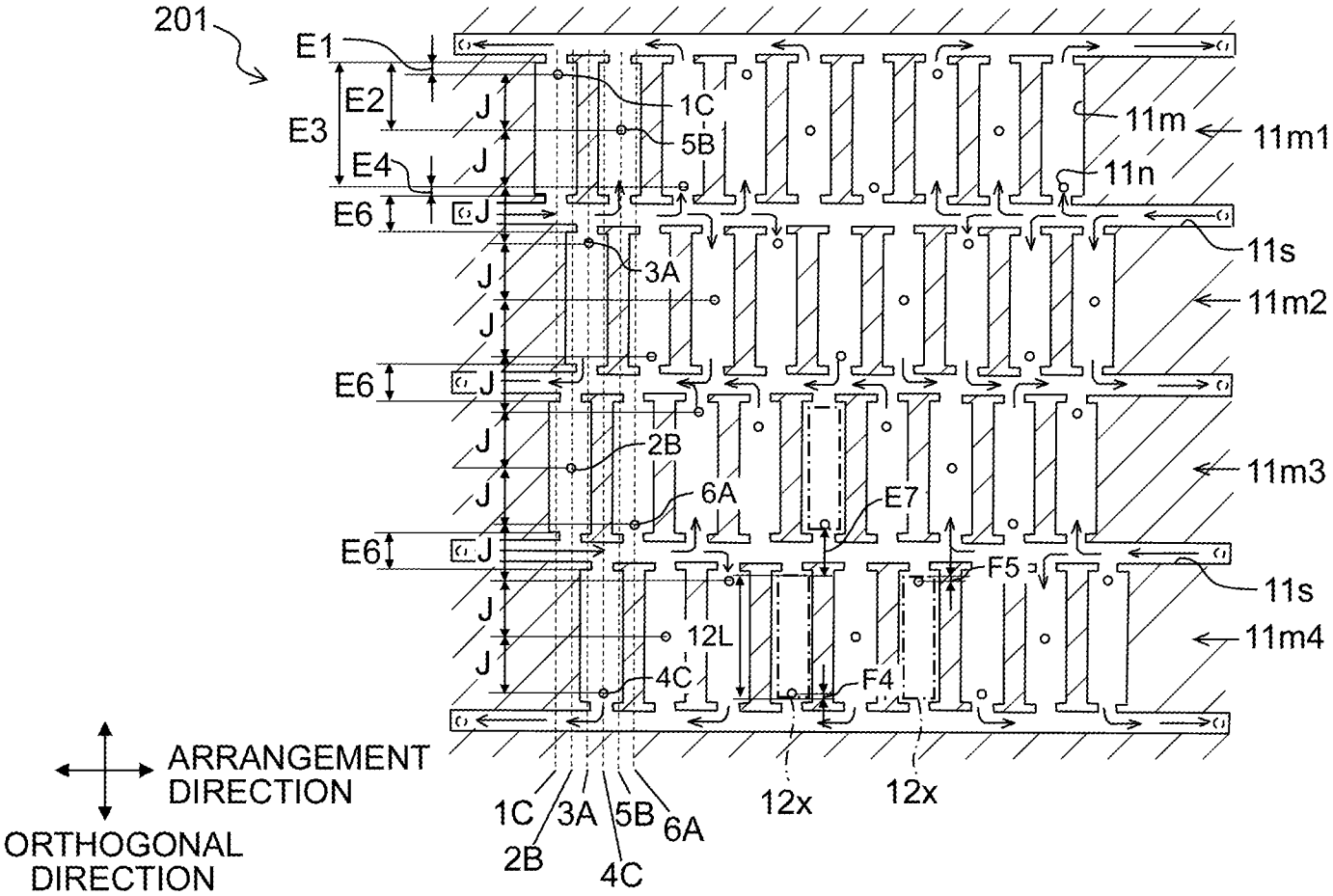
FIG. 6 is a cross-sectional view, of a head according a second embodiment of the present teaching, corresponding to FIG. 2.

Next, a head 201 according to a second embodiment of the present teaching will be described below by referring to FIG. 6. In the head 201, the plurality of nozzles 11*n* belonging to each of the pressure chamber rows 11*m*1 to 11*m*4 are lined up in the arrangement direction, and form three nozzle rows arranged side-by-side in the orthogonal direction. As the number of nozzle rows to which the plurality of nozzles 11*n* belongs becomes larger, the air curtain along the arrangement direction is hard to be formed, and the air flow in the orthogonal direction which is generated due to the conveyance of the paper 9 can pass easily between the nozzles 11*n* adjacent in the arrangement direction.

The plurality of nozzles 11*n* belonging to the each of the pressure chamber rows 11*m*1 to 11*m*4 are arranged such that, a distance in the orthogonal direction from one end in the orthogonal direction of the pressure chamber 11*m* communicating with the nozzle 11*n* mutually differs from the distance for another nozzle 11*n* adjacent in the arrangement direction, and the position in the orthogonal direction mutually differs from a position for the another nozzle 11*n*. For example, as depicted in FIG. 6, a distance E1 in the orthogonal direction from one end (upper end in FIG. 6) of the pressure chamber 11*m* communicating with that nozzle 11*n* in the first nozzle 11*n* from left in the pressure chamber row 11*m*1 differs from a distance E2 in the orthogonal direction from one end of the pressure chamber 11*m* communicating with the nozzle 11*n* in the second nozzle (another nozzle adjacent in the arrangement direction to the first nozzle from left) 11*n* from left in the pressure chamber row 11*m*1. Furthermore, the distance E2 differs from a distance E3 in the orthogonal direction from one end of the pressure chamber 11*m* communicating with the nozzle 11*n* in the third nozzle (another nozzle adjacent in the arrangement direction to the second nozzle from left) 11*n* from left in the pressure chamber row 11*m*1. Moreover, a position in the orthogonal direction of the first nozzle 11*n* from left in the pressure chamber row 11*m*1 differs from a position in the orthogonal direction of the second nozzle 11*n* from left in the pressure chamber row 11*m*1. The position in the orthogonal direction of the second nozzle 11*n* from left in the pressure chamber row 11*m*1 differs from a position in the orthogonal direction of the third nozzle 11*n* from left in the pressure chamber row 11*m*1.

A position of a nozzle other than nozzles positioned at ends in the arrangement direction, out of the plurality of nozzles 11*n* belonging to each of the pressure chamber rows 11*m*1 to 11*m*4, differs from a position of a nozzle adjacent on both sides in the arrangement direction. In the present embodiment, the plurality of nozzles 11*n* belonging to each of the pressure chamber rows 11*m*1 to 11*m*4 is arranged such that a position in the orthogonal direction of each differs, and position in the orthogonal direction of alternate nozzles are same. In other words, the plurality of nozzles 11*n* belonging to each of the pressure chamber rows 11*m*1 to 11*m*4 form three nozzle rows side-by-side in the orthogonal direction, each nozzle row arranged in the arrangement direction.

A distance 2J (=J×2) in the orthogonal direction between two most separated nozzles 11*n* in the orthogonal direction (in the present embodiment, two nozzles 11*n* arranged sandwiching one nozzle 11*n* in the arrangement direction) is equal in the four pressure chamber rows 11*m*1 to 11*m*4.

The distance 2J is not less than a distance in the orthogonal direction from the nozzle 11*n* up to an end portion near the nozzle 11*n* in the orthogonal direction out of two ends in the orthogonal direction of one pressure chamber 11*m* communicating with the nozzle 11*n*, in each of these two nozzles 11*n*. For example, as depicted in FIG. 6, the distance 2J in the orthogonal direction between the first and the third nozzles 11*n* from left of the pressure chamber row 11*m*1 is not less than the distance E1 in the orthogonal direction, from the first nozzle 11*n* from left in the pressure chamber row 11*m*1 up to the end portion (upper end in FIG. 6) near the nozzle 11*n* in the orthogonal direction, out of the two ends in the orthogonal direction of the one pressure chamber 11*m* communicating with the nozzle 11*n*, and is not less than a distance E4 in the orthogonal direction from the third nozzle 11*n* from left in the pressure chamber row 11*m*1 up to an end portion (a lower end in FIG. 6) near the nozzle 11*n* in the orthogonal direction out of the two ends in the orthogonal direction of the one pressure chamber 11*m* communicating with the nozzle 11*n*.

In the present embodiment, the distance E1 and the distance E4 are equal. Moreover, similarly as in the first embodiment, a distance in the orthogonal direction from the nozzle 11*n* in the two mutually most separated nozzles 2*n* in the orthogonal direction out of the plurality of nozzles 11*n* belonging to each of the pressure chamber rows 11*m*1 to 11*m*4, up to an end portion near the nozzle 11*n* in the orthogonal direction, out of the two ends in the orthogonal direction of the one pressure chamber 11*m* communicating with the nozzle 11*n* is equal for all nozzles. In other words, for all the pressure chambers 11*m* of the head 1, a relative positional relationship of the pressure chamber 11*m* and the nozzle 11*n* is equal (same). Accordingly, it is possible to suppress a problem of unevenness in jetting characteristics.

Moreover, the distance 2J is a distance in the orthogonal direction from the nozzle 11*n* up to an end portion near the nozzle 11*n* in the orthogonal direction out of two ends in the orthogonal direction of the active portion 12*x* facing the pressure chamber 11*m* communicating with the nozzle 11*n*, in each of the two nozzles 11*n*. For example, as depicted in FIG. 6, the distance 2J in the orthogonal direction between the fourth and the fifth nozzles 11*n* from left of the pressure chamber 11*m*4 is not less than a distance F4 in the orthogonal direction, from the fourth nozzle 11*n* from left in the pressure chamber row 11*m*4 up to the end portion (a lower end in FIG. 6) near the nozzle 11*n* in the orthogonal direction out of the two ends in the orthogonal direction of the active portion 12*x* facing the pressure chamber 11*m* communicating with the nozzle 11*n*, and is not less than a distance F5 in the orthogonal direction, from the sixth nozzle 11*n* from left in the pressure chamber row 11*m*4 up to an end portion (an upper end in FIG. 6) near the nozzle 11*n* in the orthogonal direction out of the two ends in the orthogonal direction of the active portion 12*x* facing the pressure chamber 11*m* communicating with the nozzle 11*n*.

A distance J in the orthogonal direction from one nozzle 11*n* up to another nozzle 11*n* adjacent in the arrangement direction (a distance in the orthogonal direction between the nozzles 11*n* that are mutually adjacent in the arrangement direction) is not less than a distance E6 in the orthogonal direction between the plurality of pressure chambers 11*m* which forms the pressure chamber row to which these two nozzles belong, and the plurality of pressure chambers 11*m* which forms another pressure chamber row adjacent in the orthogonal direction to the pressure chamber row. The four pressure chamber rows 11*m*1 to 11*m*4 are arranged at the equal distance E6 in the orthogonal direction. In other words, the distance E6 in the orthogonal direction between the plurality of pressure chambers 11*m* forming the pressure chamber row 11*m*1 and the plurality of pressure chambers 11*m* forming the pressure chamber row 11*m*2, the distance E6 in the orthogonal direction between the plurality of pressure chambers 11*m* forming the pressure chamber row 11*m*2 and the plurality of pressure chambers 11*m* forming the pressure chamber row 11*m*3, and the distance E6 in the orthogonal direction between the plurality of pressure chambers 11*m* forming the pressure chamber row 11*m*3 and the plurality of pressure chambers 11*m* forming the pressure chamber row 11*m*4 are mutually same.

The distance E6 is smaller than the length 12L in the orthogonal direction of the one active portion 12*x*.

The distance J is not less than a distance E7 between the plurality of active portions 12*x* belonging to the pressure chamber row to which these two nozzles 11*n* belong and the plurality of active portions 12*x* belonging to another pressure chamber row which is adjacent in the orthogonal direction to the abovementioned pressure chamber row. The active portions 12*x*, similar to the pressure chambers 11*m*, are also arranged at the equal distance E7 in the orthogonal direction.

Moreover, the distance J is equal to the minimum distance in the orthogonal direction from the plurality of nozzles 11*n* belonging to the one pressure chamber row up to the plurality of nozzles 11*n* belonging to another pressure chamber row which is adjacent in the orthogonal direction to the abovementioned pressure chamber row. In other words, the plurality of nozzles belonging to all the pressure chamber rows 11*m*1 to 11*m*4 is arranged at the same distance J in the orthogonal direction. Accordingly, the air flow is even harder to be perturbed, and it is possible to suppress even more assuredly, the problem of the ink jetted from each nozzle 11*n* not landing at a desired position.

The distance J is an even multiple of a distance corresponding to the maximum resolution in the orthogonal direction.

Furthermore, when there is a plurality of patterns of a distance in the orthogonal direction from the supply channel 11*s* that supplies an ink to the pressure chamber 11*m* communicating with the nozzle 11*n*, of the plurality of nozzles 11*n* corresponding to the plurality of dots lined up in the arrangement direction, the plurality of nozzles 11*n* is arranged in a pattern in which the frequency of consecutive nozzles 11*n* with the equal distance in the orthogonal direction from the supply channel 11*s*, is the minimum. Specifically, in FIG. 6, numbers "1" to "6" are assigned in order from left, to the plurality of nozzles 11*n* corresponding to a plurality of dots lined up in the arrangement direction, and a nozzle 11*n* for which the distance in the orthogonal direction from the supply channel 11*s* is the minimum is let to be "A", a nozzle 11*n* for which the distance is longer than for "A" is let to be "B", and a nozzle 11*n* for which the distance is longer than for "B" is let to be "C" (in the present embodiment, since the nozzles 11*n* belonging to each pressure chamber row form three nozzle rows, the nozzles are classified into three which are "A", "B", and "C"). In the present embodiment, the nozzles 11*n* from "1" to "6" are "C", "B", "A", "C", "B", and "A".

Figure 7:
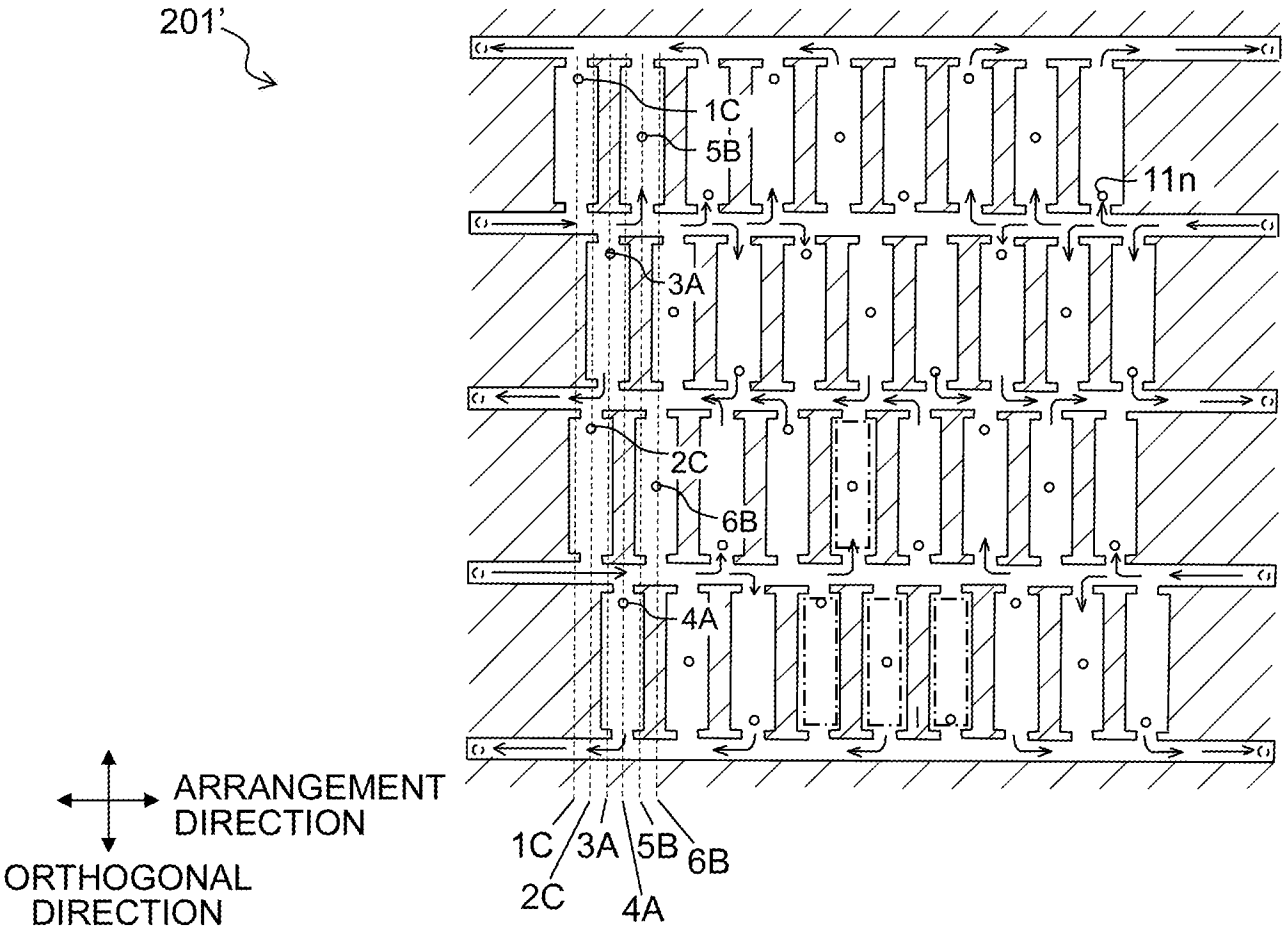
FIG. 7 is a cross-sectional view, of a head according to a modified embodiment of the second embodiment of the present teaching, corresponding to FIG. 2.

On the other hand, in a head 201' according to a modified embodiment in FIG. 7, numbers "1" to "6" are assigned in order from left to the plurality of nozzles 11*n* corresponding to the plurality of dots lined up in the arrangement direction, and when the nozzles are classified similarly as "A", "B", and "C" mentioned above, the nozzles 11*n* from "1" to "6" are "C", "C", "A", "A", "B", and "B". In other words, in the modified embodiment in FIG. 7, the frequency of consecutive nozzles 11*n* with the equal distance in the orthogonal direction from the supply channel 11*s* is larger as "A" "A", "B" "B", and "C" "C" compared to the frequency of consecutive nozzles 11*n* in the present embodiment.

In a case in which the nozzles 11*n* belonging to each pressure chamber row form three nozzle rows, there are various patterns of arrangement of the nozzles 11*n* including the pattern in the modified embodiment in FIG. 7. In the present embodiment, a pattern in which the nozzles 11*n* with the equal distance in the orthogonal direction from the supply channel 11*s* are not consecutive (continuous) has been adopted.

According to the present embodiment, it is possible to achieve the following effect apart from the similar effect achieved by an arrangement similar as in the first embodiment.

The plurality of nozzles 11*n* corresponding to the plurality of dots lined up in the arrangement direction is arranged in the pattern in which the nozzles 11*n* with the equal distance in the orthogonal direction from the supply channel 11*s* are not consecutive. Accordingly, the difference in characteristics is even more remarkable.

Third Embodiment

Figure 8:
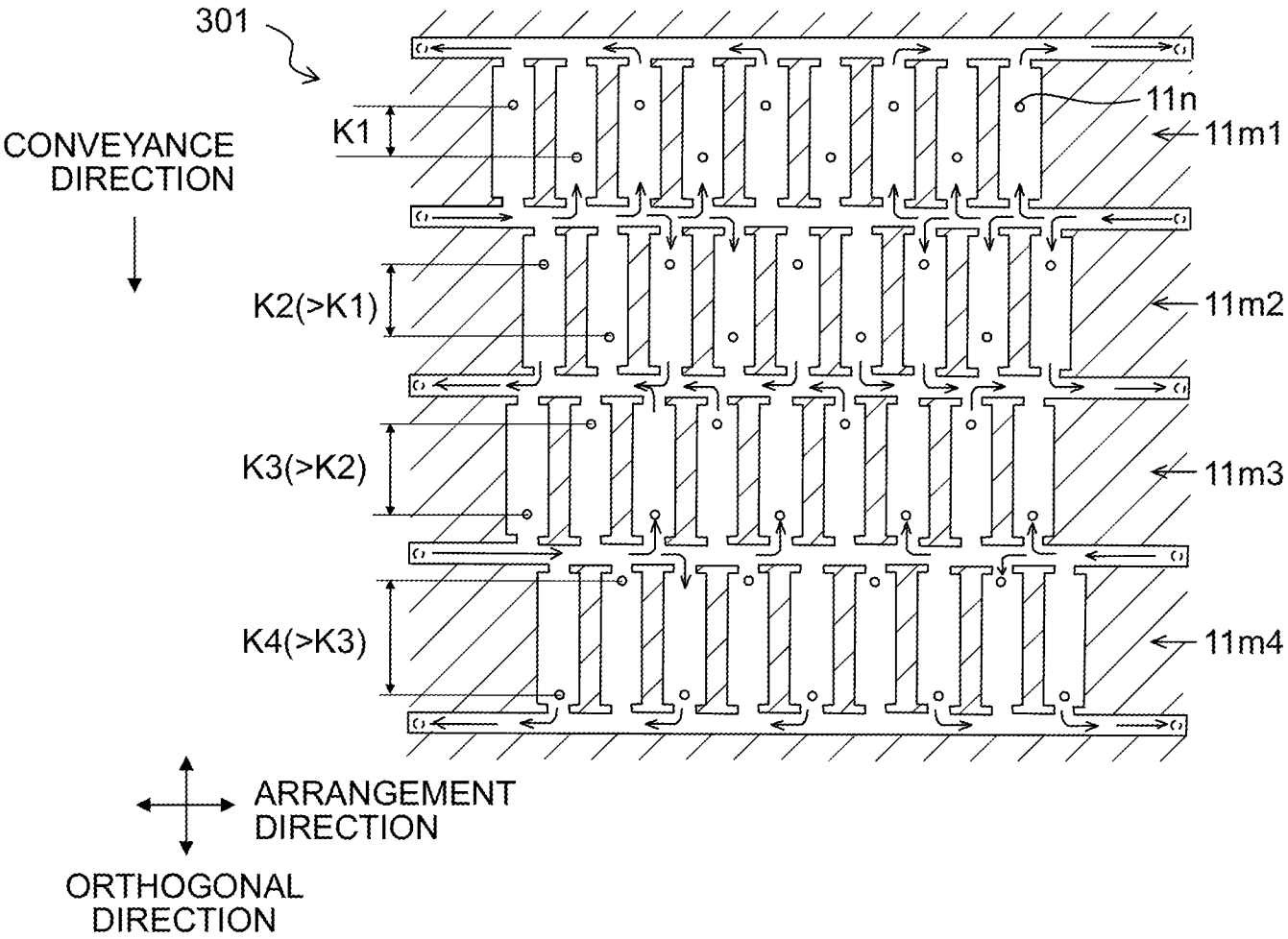
FIG. 8 is a cross-sectional view, of a head according to a third embodiment of the present teaching, corresponding to FIG. 2.

Next, for a head 301 according to a third embodiment of the present teaching, points that differ from the head 1 according to the first embodiment will be described below by referring to FIG. 8. The head 301 differs from the head 1 at a point that the distance in the orthogonal direction between the plurality of nozzles 11*n* belonging to the pressure chamber rows 11*m*1 to 11*m*4 differs for each of the pressure chamber rows 11*m*1 to 11*m*4.

Distances K1, K2, K3, and K4 (hereinafter, distances K1 to K4) in the orthogonal direction between the two nozzles 11*n* (in the present embodiment, the two nozzles 11*n* that are mutually adjacent in the arrangement direction) out of the plurality of nozzles 11*n* belonging to each of the pressure chamber rows 11*m*1 to 11*m*4 differ mutually in the four pressure chamber rows 11*m*1 to 11*m*4. Specifically, the more (farther) on a downstream side of the conveyance direction the pressure chamber row out of the four pressure chamber rows 11*m*1 to 11*m*4 is, longer is the distance in the orthogonal direction from the one nozzle 11*n* in the plurality of nozzles 11*n* belonging to that pressure chamber row up to another nozzle 11*n* which is adjacent in the arrangement direction. In other words, the distance K4 in the pressure chamber row 11*m*4 is longer than the distance K3 in the pressure chamber row 11*m*3, the distance K3 is longer than the distance K2 in the pressure chamber row 11*m*2, and the distance K2 is longer than the distance K1 in the pressure chamber row 11*m*1.

According to the present embodiment, it is possible to achieve the following effect apart from the similar effect achieved by an arrangement similar as in the first embodiment.

The more (farther) on the downstream side of the conveyance direction, the perturbation of the air flow is susceptible to become substantial. With regard to this point, according to the present embodiment, the more the pressure chamber row is on the downstream side of the conveyance direction, longer is the distance in the orthogonal direction from the one nozzle 11*n* in the plurality of nozzles 11*n* belonging to that pressure chamber row up to another nozzles 11*n* adjacent in the arrangement direction (K4>K3>K2>K1). In other words, the more on the downstream side of the conveyance direction, the air curtain along the arrangement direction is harder to be formed. Therefore, the perturbation of the air flow is hard to become large.

Fourth Embodiment

Figure 9:
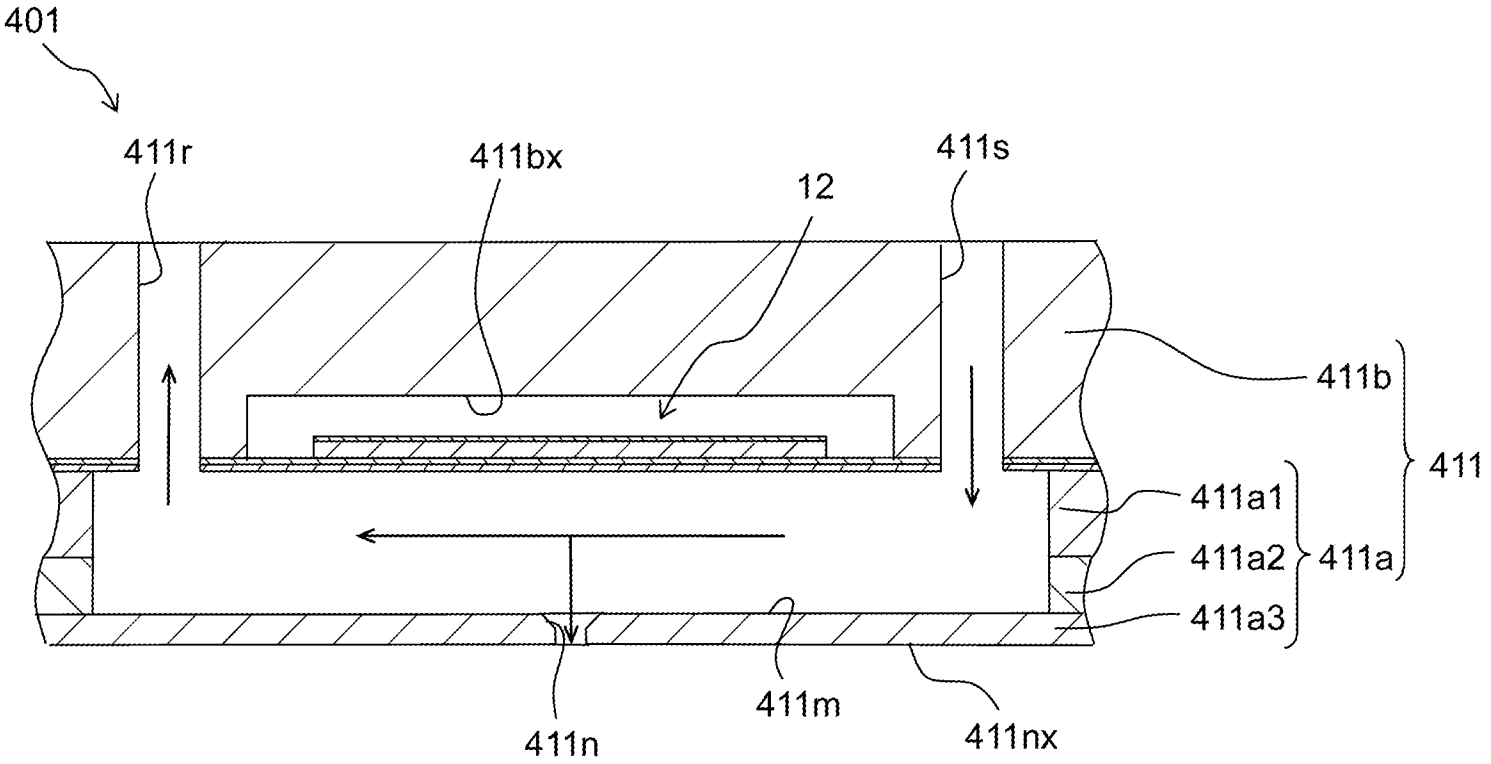
FIG. 9 is a cross-sectional view, of a head according to a fourth embodiment of the present teaching, corresponding to FIG. 3.

Next, for a head 401 according to a fourth embodiment of the present teaching, points that differ from the head 1 according to the first embodiment will be described below by referring to FIG. 9. An arrangement of pressure chambers, nozzles, a supply channel, and a return channel in the head 401 differs from that of the head 1.

In the present embodiment, a channel substrate 411 includes a channel plate 411*a* in which a plurality of pressure chambers 411*m* and a plurality of nozzles 411*n* are formed, and a reservoir plate 411*b* in which a supply channel 411*s* and a return channel 411*r* are formed.

A recess 411*bx* is formed in a lower surface of the reservoir plate 411*b*. The reservoir plate 411*b* is adhered to an upper surface of the channel plate 411*a* such that the actuator 12 is arranged in the recess 411*bx*.

The channel plate 411*a* includes three plates 411*a*1, 411*a*2, and 411*a*3 (hereinafter, plates 411*a*1 to 411*a*3), and the three plates are adhered to one another. An upper portion of the pressure chamber 411*m* is formed to be through in the plate 411*a*1. A lower portion of the pressure chamber 411*m* is formed to be through in the plate 411*a*2. The nozzle 411*n* is formed to be through in the plate 411*a*3. A lower surface of the plate 411*a*3 (a lower surface of the channel plate 411*a*) is a nozzle surface 411*nx* in which the plurality of nozzles 411*n* open.

The supply channel 411*s* and the return channel 411*r* are positioned at an upper side of each pressure chamber 11*m*, and partially overlaps with each pressure chamber 11*m* when viewed from a perpendicular (vertical) direction. The supply channel 411*s* supplies an ink from the upper side to each pressure chamber 11*m*. The ink supplied to each pressure chamber 11*m* moves horizontally, and some of the ink is jetted from the nozzle 11*n* while the remaining ink inflows into to the return channel 411*r* from the upper side, and is returned to the storage chamber 14*x* (refer to FIG. 4).

The preferred embodiments of the present teaching and, modified embodiments of the preferred embodiments have been described above. However, the present teaching is not restricted to the abovementioned embodiments and modified embodiments, and various design modifications are possible within the scope of the patent claims.

Other Modified Examples

The orthogonal direction is not restricted to be parallel to the conveyance direction, and may intersect the conveyance direction for example.

A position of a nozzle other than nozzles positioned at end in the arrangement direction, of the plurality of nozzles belonging to one pressure chamber row, may not differ from a position in the orthogonal direction of nozzles adjacent on both sides in the arrangement direction. In other words, the nozzle may be at a position in the orthogonal direction different from a position of one of the adjacent nozzles, and may be at a position in the orthogonal direction same as a position of the other adjacent nozzle.

A distance in the orthogonal direction, between two mutually most separated nozzles in the orthogonal direction, in the plurality of nozzles belonging to one pressure chamber row, may be less than a distance in the orthogonal direction from that nozzle up to an end portion near the nozzle in the orthogonal direction out of two ends in the orthogonal direction of the active portion facing the pressure chamber communicating with that nozzle, for each of the two nozzles.

A distance in the orthogonal direction from one nozzle up to another nozzle that is adjacent in the arrangement direction, in the plurality of nozzles belonging to one pressure chamber row may not be equal to the minimum distance in the orthogonal direction from the plurality of nozzles belonging to one pressure chamber row up to the plurality of nozzles belonging to another pressure chamber row that is adjacent in the orthogonal direction to that pressure chamber row, and may be more than the minimum distance, or may be less than the minimum distance.

A distance in the orthogonal direction from one nozzle up to another nozzle that is adjacent in the arrangement direction, of the plurality of nozzles belonging to one pressure chamber row may be less than a distance in the orthogonal direction between the plurality of pressure chambers forming the one pressure chamber row and the plurality of pressure chambers forming another pressure chamber row that is adjacent in the orthogonal direction to that pressure chamber row, or may be less than a distance in the orthogonal direction between the plurality of active portions belonging to one pressure chamber row and the plurality of active portions belonging to another pressure chamber row that is adjacent in the orthogonal direction to that pressure chamber row, or may not be an even multiple of the distance corresponding to the maximum resolution in the orthogonal direction.

When there is a plurality of patterns of a distance in the orthogonal direction from the supply channel of the plurality of nozzles corresponding to the plurality of dots lined up in the arrangement direction, the plurality of nozzles corresponding to the plurality of dots lined up in the arrangement direction may have been arranged in an arbitrary pattern.

Each nozzle may not be arranged in the pressure chamber area and/or in the active portion area.

The plurality of nozzles belonging to one pressure chamber row may form four or more than four nozzle rows. For example, the number of nozzle rows belonging to a pressure chamber row including the pressure chamber may be let to be large in proportion to the length in the orthogonal direction of each pressure chamber.

The plurality of nozzles belonging to all of the plurality of pressure chamber rows may not be arranged at an equal distance in the orthogonal direction.

The number of the pressure chamber rows is not restricted to four, and may be one or more than one.

A distance in the orthogonal direction between the plurality of pressure chambers forming one pressure chamber row and the plurality of pressure chambers forming another pressure chamber row adjacent in the orthogonal direction to that pressure chamber row may not be longer than the length in the orthogonal direction of one active portion.

Positions in the orthogonal direction of the plurality of pressure chambers forming one pressure chamber row may differ. In other words, pressure chambers having mutually different position in the orthogonal direction may exist in one pressure chamber row.

A longitudinal direction of each pressure chamber is not restricted to the orthogonal direction. The longitudinal direction of each pressure chamber forming one pressure chamber row and the longitudinal direction of each pressure chamber forming another pressure chamber adjacent in the orthogonal direction to that pressure chamber row, may be mutually different. A length in the longitudinal direction of each pressure chamber forming one pressure chamber row, and a length in the longitudinal direction of each pressure chamber forming another pressure chamber row adjacent in the orthogonal direction to that pressure chamber row, may differ mutually.

The supply channel may not be arranged between two pressure chamber rows that are mutually adjacent in the orthogonal direction. For example, in a case in which there are two pressure chamber rows that are mutually adjacent in the orthogonal direction, a return channel may be arranged between the two pressure chamber rows, and the supply channel may be arranged at an outer side in the orthogonal direction, of the two pressure chamber rows.

Figure 10:
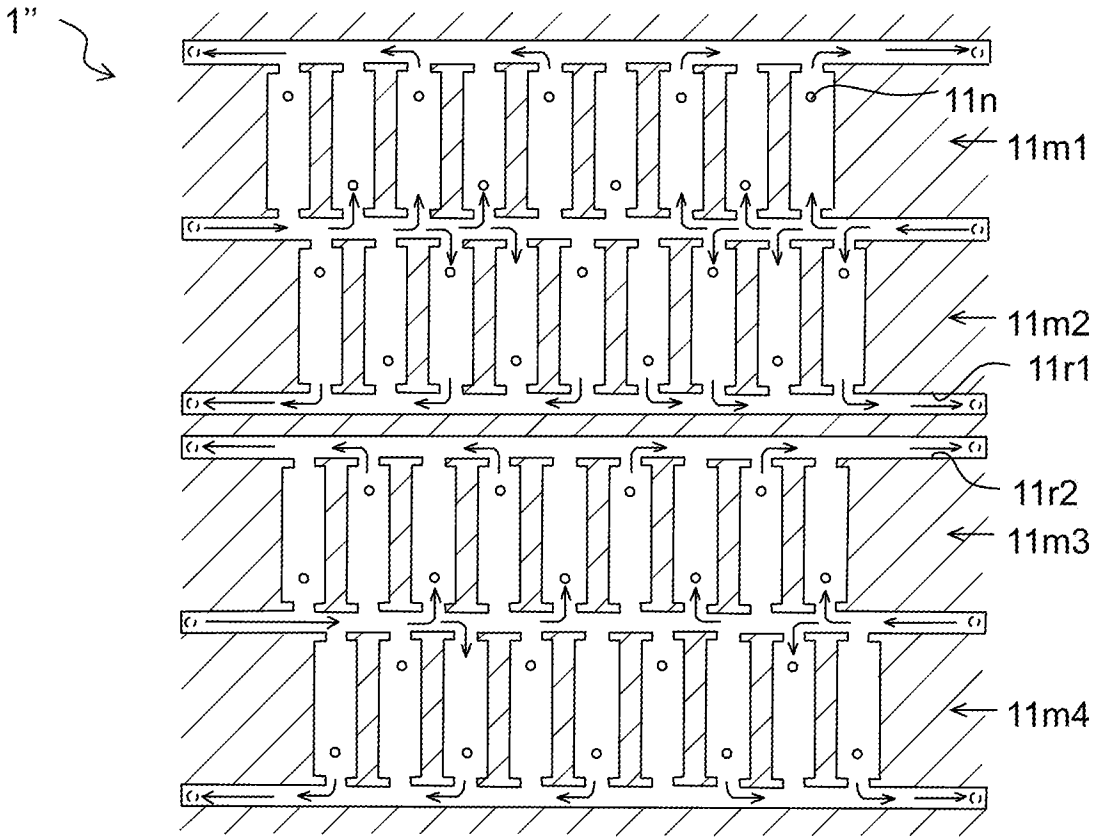
FIG. 10 is a cross-sectional view, of a head according to another modified embodiment of the first embodiment of the present teaching, corresponding to FIG. 2.

The supply channel and/or the return channel are/is not restricted to be in common to the two pressure chamber rows that are mutually adjacent in the orthogonal direction. In other words, the supply channel and/or the return channel may be provided for each pressure chamber row. For example, instead of providing the supply channel 11*s* that is in common to these pressure chamber rows 11*m*1 and 11*m*2, between the pressure chamber row 11*m*1 and the pressure chamber row 11*m*2 in FIG. 2, a supply channel that supplies an ink to the pressure chamber row 11*m*1 and a supply channel that supplies an ink to the pressure chamber 11*m*2 may be provided. Similarly, as in a head 1" according to a modified embodiment in FIG. 10, a return channel 11*r*1 which returns an ink from the pressure chamber row 11*m*2 to the storage chamber 14*x* and a return channel 11*r*2 which returns an ink from the pressure chamber row 11*m*3 to the storage chamber 14*x* may be provided between the pressure chamber row 11*m*2 and the pressure chamber row 11*m*3. According to the modified embodiment in FIG. 10, it is possible to supply inks of mutually different types (such as mutually different colors) to the pressure chamber rows 11*m*1 and 11*m*2 and the pressure chamber rows 11*m*3 and 11*m*4, and to make jet inks of mutually different types from the nozzles 11*n* belonging to the pressure chamber rows 11*m*1 and 11*m*2, and the pressure chamber rows 11*m*3 and 11*m*4 respectively.

A relationship in a vertical direction of the supply channel and/or the return channel and each pressure chamber is not restricted to the relationship exemplified in the embodiments described above, and can be changed arbitrarily. For example, the supply channel and the return channel may be positioned at a lower side of each pressure chamber, and may supply an ink to each pressure chamber from a lower side.

The return channel may not be formed in the channel substrate (in other words, an arrangement is not restricted to an arrangement of circulating an ink between the storage chamber and each pressure chamber). The channel substrate is not restricted to be formed by adhering a plurality of members to one another, and may be formed by a single member.

A supply port through which a liquid is supplied from the storage chamber may be formed at one end in a longitudinal direction in one channel that supplies the liquid to the plurality of pressure chambers, and a discharge port through which the liquid is discharged to the storage chamber may be formed at the other end in the longitudinal direction in one channel that supplies the liquid to the plurality of pressure chambers.

The actuator is not restricted to be of the piezoelectric type in which a piezoelectric element has been used as in the embodiments described above, and may be of another type (such as a thermal type in which a heater element is used and an electrostatic type in which an electrostatic element is used).

The liquid jetting head is not restricted to be of the line type, and is also applicable to a serial type (a type of jetting a liquid on to a recording medium that is conveyed along the conveyance direction parallel to the arrangement direction, while making the head scan along the orthogonal direction). Moreover, the liquid jetting apparatus is not restricted to be equipped with a head unit which includes a plurality of liquid jetting heads, and may include a single liquid jetting head. The liquid to be jetted by the liquid jetting head is not restricted to an ink, and may be an arbitrary liquid (such as a process liquid (processing solution, treatment liquid) which coagulates (aggregates) or precipitates constituents in an ink). The recording medium is not restricted to paper, and may be an arbitrary medium on which a recording is possible (such as a cloth). The present teaching is not restricted to a printer, and is also applicable to a facsimile, a copy machine, and a multifunction device.

What is claimed is:

1. A liquid jetting head, comprising:

a channel substrate having a nozzle surface in which nozzles are open, the channel substrate being formed with pressure chambers communicating with the nozzles respectively; and an actuator configured to be driven to deform the pressure chambers, wherein the pressure chambers form pressure chamber rows arranged in a first direction which is parallel to the nozzle surface, each of the pressure chamber rows extending in a second direction which is parallel to the nozzle surface and orthogonal to the first direction, the channel substrate is formed with at least one supply channel which extends in the second direction and through which liquid is supplied to each of the pressure chambers from a storage chamber storing the liquid, the nozzles are arranged such that liquid droplets of the liquid discharged from the nozzles onto a medium form dots aligned in the second direction, and the nozzles are arranged such that the number of nozzles, which are adjacent in the second direction and which have the same distance in the first direction from the at least one supply channel, is the minimum.

2. The liquid jetting head according to claim 1, wherein the nozzles include first nozzles and second nozzles, each of the first nozzles is apart from the at least one supply channel in the first direction by a first distance, and each of the second nozzles is apart from the at least one supply channel in the first direction by a second distance which is longer than the first distance.

3. The liquid jetting head according to claim 1, wherein the nozzles are arranged such that nozzles having the same distance in the first direction from the at least one supply channel are not consecutive for 84 μm or more in the second direction.

4. The liquid jetting head according to claim 3, wherein the nozzles are arranged such that nozzles having the same distance in the first direction from the at least one supply channel are not consecutive in the second direction.

5. The liquid jetting head according to claim 1, wherein the pressure chambers include first pressure chambers arranged in the second direction to form a first pressure chamber row included in the pressure chamber rows, the nozzles form nozzle groups arranged in the first direction, the nozzle groups include first nozzle group corresponding to the first pressure chamber row, any two nozzles, which are included in the first nozzle group and adjacent to each other in the second direction, are arranged at different positions in the channel substrate with respect to the first direction, and a distance in the first direction between any two nozzles, which are included in the first nozzle group and adjacent in the second direction, is an even multiple of a distance corresponding to the maximum resolution in the first direction.

6. The liquid jetting head according to claim 1, wherein the channel substrate is further formed with a return channel through which the liquid is returned to the storage chamber from the pressure chambers.

7. The liquid jetting head according to claim 1, wherein the pressure chambers include first pressure chambers arranged in the second direction to form a first pressure chamber row included in the pressure chamber rows, each of the first pressure chambers has a first end on one side in the first direction and a second end on the other side in the first direction, the nozzles include first nozzles communicating with the first pressure chambers respectively, any two first nozzles, which are included in the first nozzles and adjacent to each other in the second direction, are arranged at different positions in the channel substrate with respect to the first direction and different in a first distance, the first distance being a distance in the first direction between each first nozzle and the first end of each first pressure chamber communicating with the first nozzle, the first nozzles include farthest two first nozzles that are separated from each other farthest with respect to the first direction, a second distance in the first direction between the farthest two first nozzles is not less than a third distance, the third distance being a distance between each of the farthest two first nozzles and a nearest end of each first pressure chamber communicating with the first nozzle, the nearest end of the first pressure chamber being one of the first end and the second end which is nearer to the first nozzle in the first direction, and the first pressure chambers are arranged at positions which are the same with respect to the first direction.

8. The liquid jetting apparatus according to claim 7, wherein each of the first nozzles is arranged in a pressure chamber area formed by projecting the first pressure chamber communicating with the first nozzle on the nozzle surface from a direction perpendicular to the nozzle surface.

9. The liquid jetting head according to claim 8, wherein the actuator includes active portions facing the pressure chambers respectively, in the direction perpendicular to the nozzle surface, each of the active portions has two ends in the first direction, and the second distance is not less than a fourth distance, the fourth distance being a distance between each of the farthest two first nozzles and a nearest end of an active portion facing the first pressure chamber which communicates with the first nozzle, the nearest end of the active portion being one of the two ends which is nearer to the first nozzle in the first direction.

10. The liquid jetting head according to claim 9, wherein each of the first nozzles is arranged in an active portion area formed by projecting the active portion facing the first pressure chamber which communicates with the first nozzle on the nozzle surface from the direction perpendicular to the nozzle surface.

11. The liquid jetting head according to claim 8, wherein each of the first nozzles, excluding the first nozzles positioned at both ends in the second direction, is arranged at a position which is different from positions of the first nozzles arranged to be adjacent to the first nozzle on both sides in the second direction, with respect to the first direction.

12. The liquid jetting head according to claim 11, wherein the pressure chambers further include second pressure chambers which form a second pressure chamber row, the second pressure chamber row being included in the pressure chamber rows and adjacent to the first pressure chamber row in the first direction in the channel substrate, the nozzles further include second nozzles communicating with the second pressure chambers respectively, and a fifth distance in the first direction between two first nozzles that are adjacent in the second direction is not less than a sixth distance, the sixth distance being the minimum distance in the first direction between the first nozzles and the second nozzles.

13. The liquid jetting head according to claim 12, wherein the fifth distance is equal to the sixth distance.

14. The liquid jetting head according to claim 13, wherein each of the nozzles belongs to one of the pressure chamber rows, and the nozzles are arranged at an equal spacing distance with respect to the first direction.

15. The liquid jetting head according to claim 12, wherein the first direction is parallel to a conveyance direction in which a recording medium is conveyed, the second pressure chamber row is formed on a downstream side in the conveyance direction of the first pressure chamber row, and a seventh distance in the first direction between two second nozzles that are adjacent in the first direction is more than the fifth distance.

16. The liquid jetting head according to claim 12, wherein the fifth distance is not less than a distance in the first direction between the first pressure chambers and the second pressure chambers.

17. The liquid jetting head according to claim 12, wherein the actuator includes active portions facing the pressure chambers respectively, in the direction perpendicular to the nozzle surface, the active portions include first active portions facing the first pressure chambers respectively, and second active portions facing the second pressure chambers respectively, and the fifth distance is not less than a distance in the first direction between the first active portions and the second active portions.

18. The liquid jetting head according to claim 17, wherein a distance in the first direction between the first pressure chambers and the second pressure chambers is less than a length of each of the active portions in the first direction.

* * * * *